US007682183B2

(12) United States Patent
Kanazawa

(10) Patent No.: US 7,682,183 B2
(45) Date of Patent: Mar. 23, 2010

(54) ELECTRIC JUNCTION BOX

(75) Inventor: Masashi Kanazawa, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 159 days.

(21) Appl. No.: 11/920,504

(22) PCT Filed: Feb. 27, 2006

(86) PCT No.: PCT/JP2006/303555

§ 371 (c)(1),
(2), (4) Date: Nov. 28, 2007

(87) PCT Pub. No.: WO2006/134690

PCT Pub. Date: Dec. 21, 2006

(65) Prior Publication Data

US 2009/0023326 A1 Jan. 22, 2009

(30) Foreign Application Priority Data

Jun. 13, 2005 (JP) ..... 2005-171867

(51) Int. Cl.
*H01R 13/627* (2006.01)

(52) U.S. Cl. ..... 439/357; 439/701; 439/76.2

(58) Field of Classification Search ..... 439/357, 439/358, 353, 701, 76.2, 949
See application file for complete search history.

(56) References Cited

U.S. PATENT DOCUMENTS 3,605,070 A * 9/1971 Krafthefer ..... 439/357
5,217,386 A * 6/1993 Ohsumi et al. ..... 439/364
5,624,280 A 4/1997 Kato
5,868,583 A * 2/1999 Naitou et al. ..... 439/76.2
6,126,458 A * 10/2000 Gregory et al. ..... 439/76.2
6,413,118 B2 * 7/2002 Fukatsu ..... 439/542
6,761,567 B2 * 7/2004 Onizuka et al. ..... 439/76.2
7,485,012 B2 * 2/2009 Daugherty et al. ..... 439/701

FOREIGN PATENT DOCUMENTS

JP A-07-135717 5/1995
JP U-07-032874 6/1995
JP A-09-180831 7/1997
JP A-11-332059 11/1999
JP A-2001-155820 6/2001
JP A-2002-305063 10/2002
JP A-2003-347003 12/2003
JP A-2005-116230 4/2005

* cited by examiner

*Primary Examiner*—Xuong M Chung-Trans
(74) *Attorney, Agent, or Firm*—Oliff & Berridge PLC

(57) ABSTRACT

An electric junction box where a connector receiving section is provided in a case that receives an internal circuit, and where a connector that is connected to a wire harness terminal is fitted in the connector receiving section. In the electric junction box, a peripheral wall of the connector receiving section is of a square frame shape, a flexible section is formed by cutting the peripheral wall, a locking hole is formed in the flexible section, a locking claw is provided at the connector fitted in the connector receiving section, the claw being at a position that faces the locking hole of the flexible section. When the locking claw of the connector is inserted into and engaged with the locking hole of the flexible section, the connector is joined in a locking manner to the connector receiving section.

8 Claims, 7 Drawing Sheets

Prior Art

ELECTRIC JUNCTION BOX

TECHNICAL FIELD

The present invention relates to an electric junction box. More particularly, in an electric junction box for connecting an internal circuit thereof and electric wires to each other by fitting a connector connected with terminals of the electric wires in each of connector accommodation parts provided on an outer surface of the electric junction box, the present invention is intended to provide a large number of connector accommodation parts at a high density, with narrow partitioning walls partitioning adjacent connector accommodation parts from each other.

BACKGROUND ART

Conventionally connector accommodation parts from which tabs provided in an internal circuit composed of bus bars and the like are projected are formed on the outer surface of the case of the electric junction box which is mounted on a car. By fitting connectors connected with terminals of electric wires in the connector accommodation parts respectively, the tabs inside the connector accommodation parts and terminals connected with the electric wires are connected to each other respectively so that the internal circuit of the electric junction box and the electric wires are connected with each other.

The present applicant proposed an electric junction box for connecting electric wires and the internal circuit of the electric junction box with each other by fitting connectors connected with terminals of electric wires in the connector accommodation parts respectively, as disclosed in Japanese Patent Application Laid-Open No. 7-135717 (patent document 1). As shown in FIG. 8, the groove 3*a* is formed on the peripheral wall 3 of the connector accommodation part 2 provided on the outer surface of the case of the electric junction box 1. The flexible locking piece is provided on the outer surface of the connector. The locking claw is provided on the locking piece. The locking claw is locked to the groove 3*a* to lock the connector to the connector accommodation part 2. The locking piece of the connector is unlocked from the locking claw not with a jig but manually to remove the connector from the connector accommodation part 2. Because the locking piece of the connector can be flexed manually, the locking piece is large. Thus the electric junction box of the patent document 1 has a problem that it has a large connector accommodation part.

Because as described above, the locking piece of the connector can be easily flexed, the protection wall 4 projected into the connector accommodation part 2 is provided at both sides of the groove 3*a* of the connector accommodation part 2 to prevent an external interference member from interfering with the locking piece so that the locking claw is accidentally unlocked from the groove. Thus inside the connector accommodation part 2, it is necessary to form a space in which the protection wall 4 is provided. Thus the connector accommodation part 2 is large, which causes the electric junction box to be large.

The connector fitted in the connector accommodation part of the electric junction box is hardly removed. In many cases, it is unnecessary that the connector is required to be removably mounted on the connector accommodation part.

Patent document 1: Japanese Patent Application Laid-Open No. 7-135717

DISCLOSURE OF THE INVENTION

Problem to be Solved by the Invention

The present invention has been made in view of the above-described problems. Therefore it is an object of the present invention to improve a construction for locking a connector to a connector accommodation part to make the connector accommodation part small and an electric junction box compact.

Means for Solving the Problem

To achieve the object, the present invention provides an electric junction box in which connector accommodation parts are provided in a case that accommodates an internal circuit, and connectors connected with a wire harness terminal are fitted in the connector accommodation parts respectively.

In this construction, a peripheral wall of each of the connector accommodation parts is quadrilateral frame-shaped; a flexible piece is formed by cutting the peripheral wall; a locking hole is formed through the flexible piece; a locking claw is formed on each of the connectors to be fitted in the connector accommodation parts respectively at a position thereof opposed to the locking hole of the flexing piece. The locking claw of each of the connectors to be fitted in the connector accommodation parts respectively is inserted into and locked to the locking hole of each flexible piece, so that the connectors are connected to the connector accommodation parts respectively.

In the above-described construction, the peripheral wall of the connector accommodation part is cut to form the flexing piece, and the locking claw of the connector is locked to the locking hole formed on the flexible piece to connect the connector to the connector accommodation part in a locking manner. Therefore it is unnecessary to provide a large locking construction inside the connector accommodation part and thereby make the connector accommodation part small.

Because the flexible piece is formed by cutting the peripheral wall of the connector accommodation part, other members hardly interfere with the flexible piece. Therefore unlike the conventional construction, it is unnecessary to form the protection wall for protecting the locking position at both sides thereof to prevent the locking claw from being unlocked from the groove and thus possible to make the connector accommodation part small. Because it is unnecessary to form a large locking portion or a large protection wall inside the connector accommodation part, it is possible to make the connector accommodation part small, form the quadrilateral connector accommodation part having little convex and concave portions, and provide a large number of connector accommodation parts at a high density.

It is preferable that the flexible piece is formed at a pair of corners disposed on a diagonal line of the peripheral wall.

In the above-described construction, because the connector is connected to the connector accommodation part in the locking manner at two positions located on the diagonal line of the peripheral wall, a sufficiently high coupling force can be obtained. Even though the locking claw is unlocked from the locking hole at one of the two locking portions, the connector can be locked at the other locking portion.

It is preferable that a peripheral wall is cut from an inner surface of the peripheral wall on which the connector is fitted toward an inside of the peripheral wall in a shape of L in a horizontal section, so that one side edge of the flexing piece is continuous with the peripheral wall and a gap is formed at a back surface and other side edge thereof by the cutting; and in removing the connector from the connector accommodation part, an unlocking jig is inserted between the flexible piece and the connector to unlock the connector from the connector accommodation part.

The connector to be fitted in the connector accommodation part of the electric junction box of the present invention is not provided with the flexible locking piece unlike the conventional electric junction box and cannot be unlocked and removed manually from the connector accommodation part. But in the above-described construction, it is possible to unlock the locking claw from the locking hole and remove the connector from the connector accommodation part by inserting the unlocking jig between the flexible piece and the connector and flexing the flexible piece toward the back side thereof.

It is preferable that a stepped convex portion is formed at a lower portion of the peripheral wall inner surface of a side on which the flexible piece is formed with the stepped convex portion spaced at an interval from both corners of the peripheral wall of the connector accommodation part; and a shallow concave portion in which the stepped convex portion is fitted is formed at a position of a surface of the connector opposed to the stepped convex portion.

In the above-described construction, in inserting the connector into the connector accommodation part, the stepped convex portion formed on the connector accommodation part fits in the concave portion formed on the connector. Thereby the insertion position of the connector can be regulated.

When the connector is inserted into the connector accommodation part, followed by the fitting of the stepped convex portion of the connector accommodation part in the concave portion of the connector, the connector is pressed by the stepped convex portion disposed at both longer sides of the connector accommodation part. Thus the connector can be held inside the connector accommodation part at a required force. Although the connector is pressed by the stepped convex portion of the connector accommodation part, the upper-side open end of the connector accommodation part can be made larger than the connector. Thus the connector can be easily inserted into the connector accommodation part.

The stepped convex portion may be formed on the inner surface of the peripheral wall of the sides of the connector accommodation part on which the flexible piece is not formed.

It is preferable that a stepped projection is formed on an inner surface of a side of the connector accommodation part on which the flexing piece is not formed; and a groove in which the stepped projection is fitted is formed at a position of a surface of the connector opposed to the stepped projection.

By forming the stepped projection on the inner surface of one of the sides on which the flexing piece is not formed, when an operation of inserting the connector into the connector accommodation part in a wrong direction about the axis of the connector is performed, the stepped projection interferes with the lower edge of the connector, thus preventing the connector from being inserted into the connector accommodation part. Therefore the connector can be fitted in the connector accommodation part in the predetermined direction.

By forming the stepped projection at different positions in dependence on the connector accommodation part, it is impossible to fit connectors other than the predetermined connector in the connector accommodation part. Thereby it is possible to prevent an erroneous insertion of the connector.

The stepped projection may be formed on the peripheral wall inner surface of the side of the connector accommodation part on which the flexible piece is formed.

It is preferable that a large number of the quadrilateral frame-shaped connector accommodation parts is provided in the case at short pitches with the peripheral wall which have an equal width over a whole length thereof and is extended partitioning the adjacent connector accommodation parts from each other; and the peripheral wall is shared by the adjacent connector accommodation part.

In the above-described construction, because the peripheral wall of the connector accommodation parts is shared by the adjacent connector accommodation part, the connector accommodation parts can be arranged at a high density. By improving the locking construction of each of the connector accommodation parts, as described above, it is possible to make the connector accommodation parts small and arrange the connector accommodation parts at a high density. Thereby it is possible to make the electric junction box very compact.

It is preferable that an internal circuit to be accommodated inside the case is constructed of printed conductors of a printed-circuit board and terminal pins fixedly connected with the printed conductors respectively; and the terminal pins are projected into each of the connector accommodation parts from terminal holes formed on a bottom wall of each of the connector accommodation parts so that the terminal pins are fittingly connected with terminals connected with electric wires disposed inside the connector.

In the above-described construction, the internal circuit of the electric junction box is constructed not of bus bars each made of a conductive metal plate, but of the printed conductors of the printed-circuit board and the terminal pins. Thus the printed conductors and the terminal pins constructing the internal circuit can be disposed at a high density.

It is preferable that electric wires of the wire harness connected with the terminal pins through the connector are electric wires of a signal circuit.

When the electric wires of the wire harness connected with the terminal pins respectively are the electric wires of the signal circuit, a low current flows through the printed conductors of the printed-circuit board and the terminal pins. Thus the printed conductors of the printed-circuit board and the terminal pins each made of a thin plate are capable of constructing the internal circuit.

EFFECT OF THE INVENTION

In the above-described construction, the peripheral wall of the connector accommodation part is cut to form the flexing piece, and the locking claw of the connector is locked to the locking hole formed through the flexible piece to lock the connector to the connector accommodation part. Therefore it is unnecessary to provide a large locking construction inside the connector accommodation part and thereby it is possible to make the connector accommodation part small. Further the connector accommodation part can be shaped almost rectangularly. Consequently it is possible to arrange a large number of connector accommodation parts efficiently and at a high density.

Because the flexible piece is formed by cutting the peripheral wall of the connector accommodation part, the flexible piece is not easily flexed. Further the connector is locked to the connector accommodation part at the two positions located on the diagonal line of the peripheral wall of the connector accommodation part. Therefore unlike the conventional construction, it is unnecessary to form the protection wall for protecting the locking position at both sides thereof to prevent the connector from being unlocked and hence a space for forming the protection wall. Thereby it is possible to make the connector accommodation part small.

EXPLANATION OF REFERENCE NUMERALS AND SYMBOLS

Figure 1:
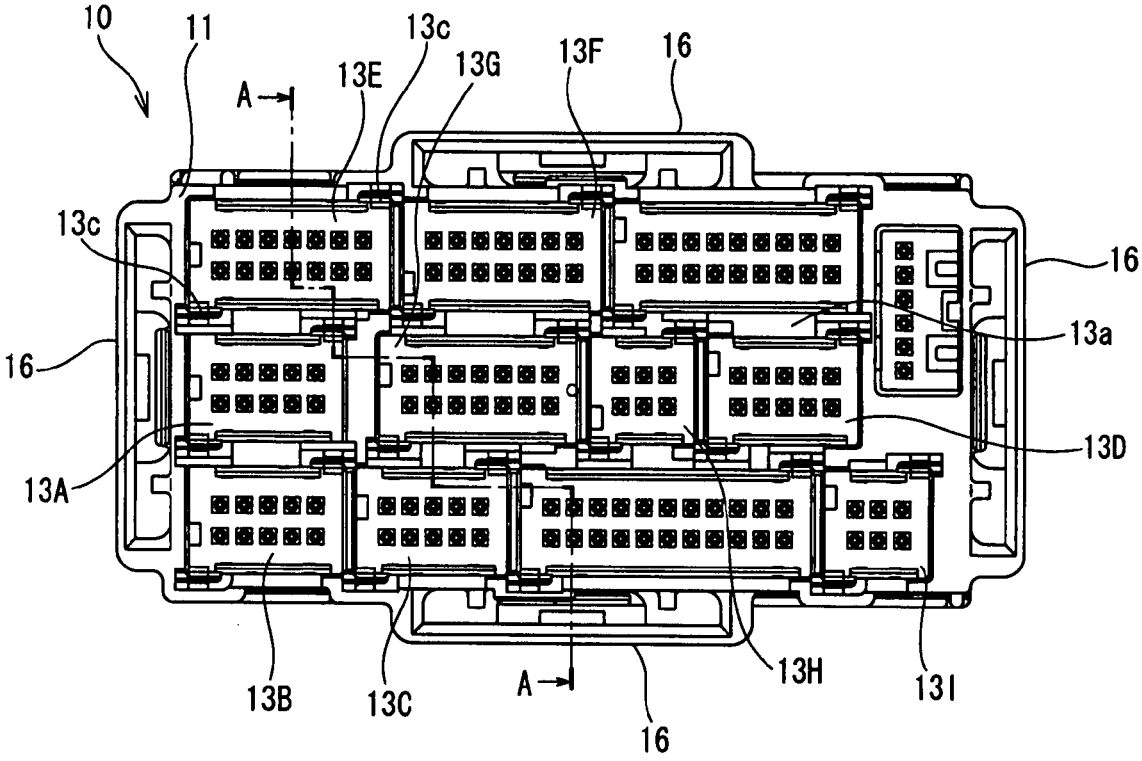
FIG. 1 is a plan view of an electric junction box of an embodiment of the present invention.

10: electric junction box
11: upper case
12: lower case
13: connector accommodation part
13*a*: peripheral wall
13*c*: flexing piece
13*d*: locking hole
13*f*: stepped convex portion
13*h*: stepped projection
20: printed-circuit board
21: printed conductor
22: terminal pin
30: connector
35: female terminal
40: unlocking jig
S1, S2: gap
w: electric wire
W/H: wire harness

BEST MODE FOR CARRYING OUT THE INVENTION

The embodiments of the present invention will be described below with reference to drawings.

FIGS. 1 through 6 show an embodiment of the present invention. A wire harness W/H constructed of electric wires w of a signal circuit is connected to an electric junction box 10 through a connector 30.

In the electric junction box 10, a case constructed of an upper case 11 and a lower case 12 accommodates a printed-circuit board 20. Terminal pins 22 fixedly connected with printed conductors 21 of the printed-circuit board 20 are respectively projected into a large number of connector accommodation parts 13 provided inside the upper case 11. A mounting portion 16 is provided on an outer surface of each side of the upper case 11 so that the electric junction box 10 can be fixedly mounted on a bracket (not shown) provided on a vehicle body.

As shown in FIG. 1, a peripheral wall 13*a* of each connector accommodation part 13 is quadrilateral frame-shaped and shared by the adjacent connector accommodation part 13. A large number of the connector accommodation parts 13 is provided at short pitches with the peripheral wall 13*a* which have an equal width over its whole length and is longitudinally extended partitioning the adjacent connector accommodation parts 13 from each other.

Figure 2:
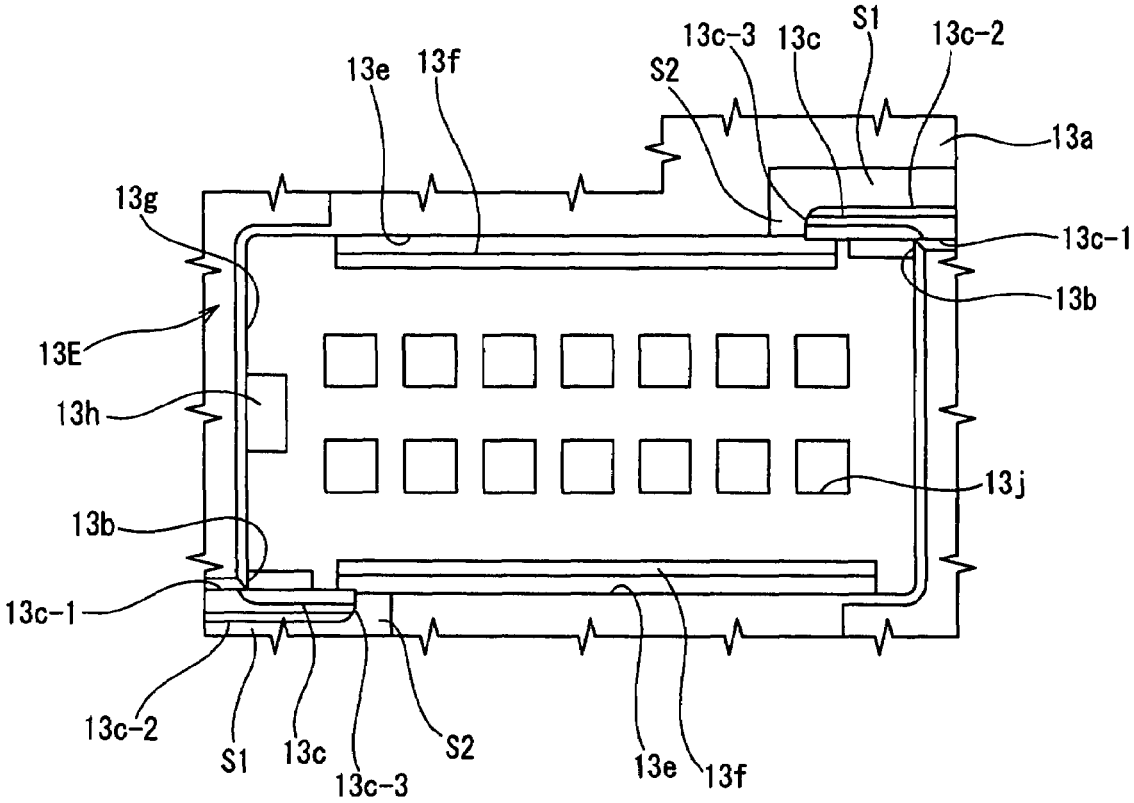
FIG. 2 is an enlarged view showing main parts of a connector accommodation part.
Figure 3:
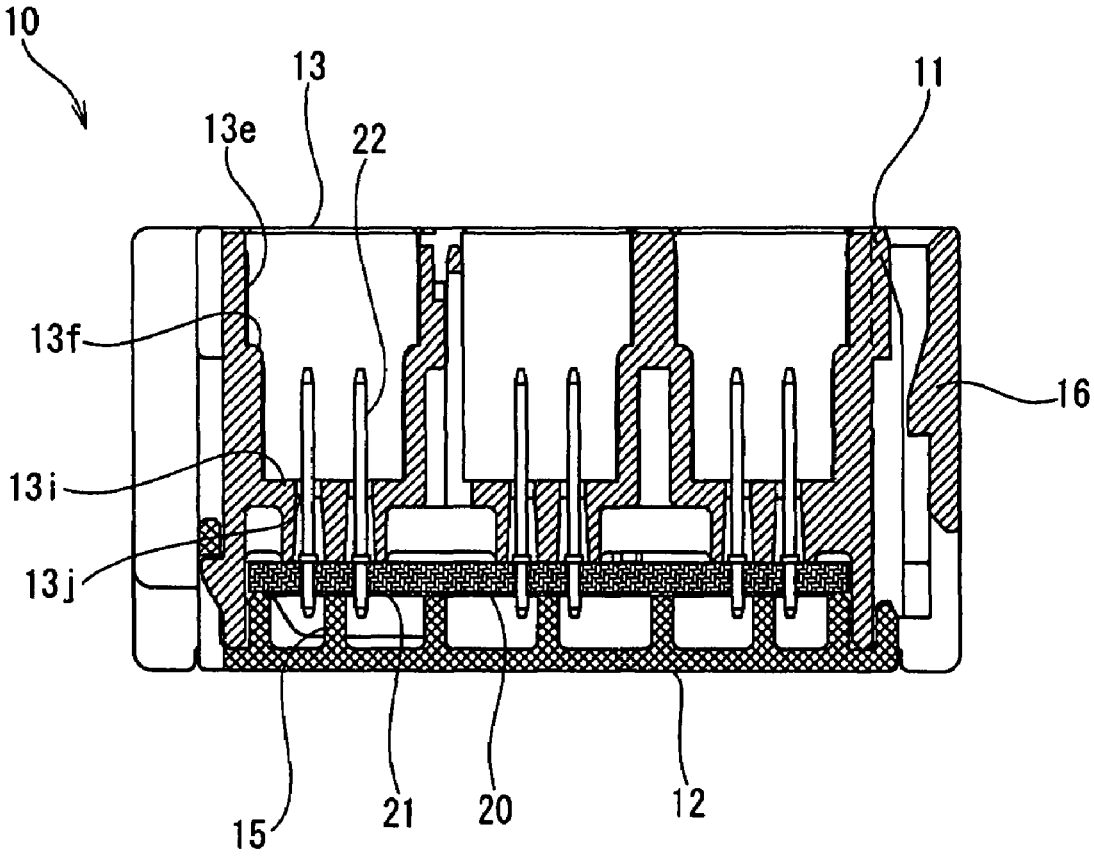
FIG. 3 is a sectional view of the electric junction box taken along a line A-A.

The connector accommodation parts 13 are different from each other in the dimensions thereof according to the number of the terminal pins 22 projected thereinto, but are similar to each other in the constructions thereof. Thus a connector accommodation part 13E shown in FIG. 2 is representatively described below.

At a pair of corners 13*b* positioned on a diagonal line of a peripheral wall 13*a* of the connector accommodation part 13E, a flexing piece 13*c* is formed by cutting the peripheral wall 13*a* in a required depth. A locking hole 13*d* is formed through the flexing piece 13*c*. As shown in FIG. 2, the peripheral wall 13*a* is cut from a peripheral wall inner surface 13*e* on which the connector fits toward an inside of the peripheral wall in the shape of L in a horizontal section, so that by the cutting, one side edge 13*c*-1 of the flexing piece 13*c* is continuous with the corner 13*b* of the peripheral wall 13*a*, and gaps S1 and S2 are formed between a back surface 13*c*-2 and the peripheral wall 13*a* and between other side edge 13*c*-3 of the flexing piece 13*c* and the peripheral wall 13*a* respectively.

A low stepped convex portion 13*f* is formed at a lower portion of the peripheral wall inner surface 13*e* of a side, of the connector accommodation part 13E, on which the flexing piece 13*c* is formed, with the stepped convex portion 13*f* spaced at an interval from both corners of the peripheral wall.

A stepped projection 13*h* is formed at a center of a lower portion of a peripheral wall inner surface 13*g* of one (left-hand side in FIG. 2) of sides, of the connector accommodation part 13E, on which the flexing piece 13*c* is not formed. In the connector accommodation part 13E, the stepped projection 13*h* is formed at the central position, of the peripheral wall inner surface 13*g*, which is spaced at an equal distance from both corners of the peripheral wall. In connector accommodation parts 13F and 13G in which the same number of the terminal pins 22 as that used in the connector accommodation part 13E can be projected, the stepped projection 13*h* is formed on the peripheral wall inner surface 13*g* at a position near one of two corners. In the connector accommodation parts 13E through 13G, the stepped projection 13*h* is formed at different positions. In connector accommodation parts 13A, 13B, 13C, 13D, 13H, and 13I in which the same number of the terminal pins 22 as that used in the connector accommodation part 13E is projected, the stepped projection 13*h* is formed at different positions.

The terminal pins 22 are soldered to the printed conductors 21 of the printed-circuit board 20 accommodated inside the case composed of the upper case 11 and the lower case 12. The terminal pins 22 are penetrated through terminal holes 13*j* respectively formed through a bottom wall 13*i* of the connector accommodation part 13 so that the terminal pins 22 are projected into the connector accommodation part 13. The printed-circuit board 20 is accommodated in the case with the printed-circuit board 20 sandwiched between the bottom wall 13*i*, projected to the lower side of the upper case 11, through which the terminal holes 13*j* are formed and ribs 15 formed on an inner surface of the lower case 12. Each of the terminal pins 22 is composed of a sectionally square thin plate having a thickness of 0.64 mm. The terminal pins 22 are disposed at short intervals of 2.2 mm.

A locking claw 31 is provided on the connector 30 to be fitted in the connector accommodation part 13 at a position opposed to the locking hole 13*d* of the flexing piece 13*c*. Formed on an outer surface of a lower portion of the connector 30 are a shallow concave portion 32 located at a position opposed to the stepped convex portion 13*f* of the connector accommodation part 13 and a groove 33 disposed at a position opposed to the stepped projection 13*h* of the connector accommodation part 13. A plurality of terminal accommodation chambers 34 is formed inside the connector 30. Female terminals 35 connected with terminals of electric wires respectively are inserted into the terminal accommodation chambers 34 and locked to the inside thereof.

Figure 4A:
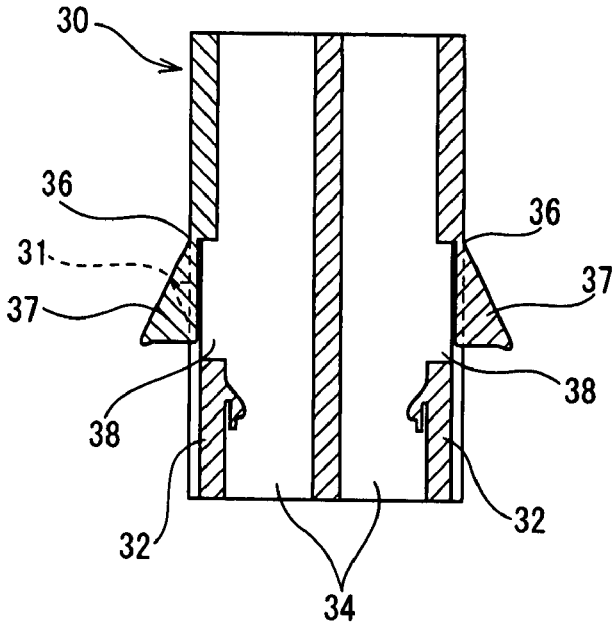
FIGS. 4A and 4B show a method of locking a terminal to a connector.
Figure 4B:
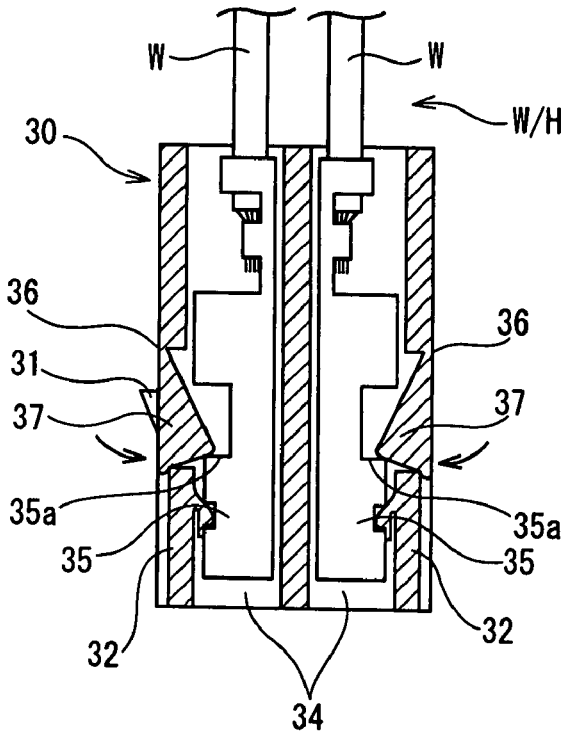

More specifically, as shown in FIG. 4(A), above the concave portion 32, a lance 37 is rotatably provided through a thin hinge 36, and an opening 38 into which the lance 37 is inserted is formed at a position opposed to the lance 37. After the female terminals 35 are accommodated inside the terminal accommodation chamber 34, as shown in FIG. 4(B), the lance 37 is rotated to the terminal accommodation chamber 34, inserted into the terminal accommodation chamber 34 through the opening 38, and locked to a locking portion 35*a* formed on each female terminal 35 to lock the female terminal 35 to the inside of the terminal accommodation chamber 34.

Figure 5:
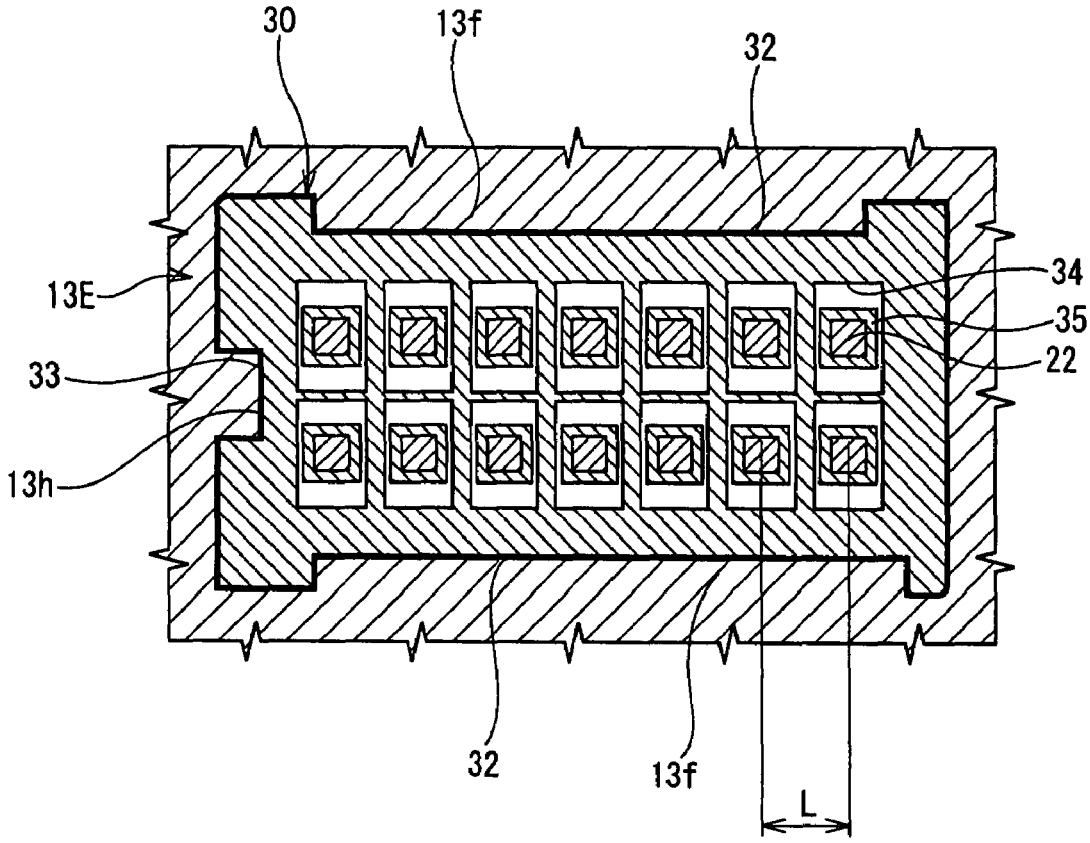
FIG. 5 is a horizontal sectional view showing a state in which the connector is fitted in a connector accommodation part.

When the connector 30 connected with the terminals of the electric wires w is inserted into the connector accommodation part 13, as shown in FIG. 5, the concave portion 32 and the groove 33 formed on the outer surface of the connector 30 are fitted on the stepped convex portion 13*f* of the connector accommodation part 13 and the stepped projection 13*h* thereof respectively, and the locking claw 31 of the connector 30 is locked to the locking hole 13*d* of the flexing piece 13*c*. Thereby the connector 30 is locked to the inside of the connector accommodation part 13. At this time, the terminal pins 22 projected into the connector accommodation part 13 are fitted on the female terminals 35 respectively connected with the electric wires w disposed inside the connector 30. Thereby an internal circuit of the electric junction box 10 and the electric wires w are connected with each other.

The sectional dimension of each terminal hole 13*j* is set larger than that of each of the terminal pin 22 to soften a stress generated by vibration of the terminal pins 22 when the terminal pins 22 are fitted on the female terminals 35 respectively. Thereby it is possible to prevent the solder of the terminal pins 22 fixed to the printed conductors 21 of the printed-circuit board 20 from cracking.

Figure 6:
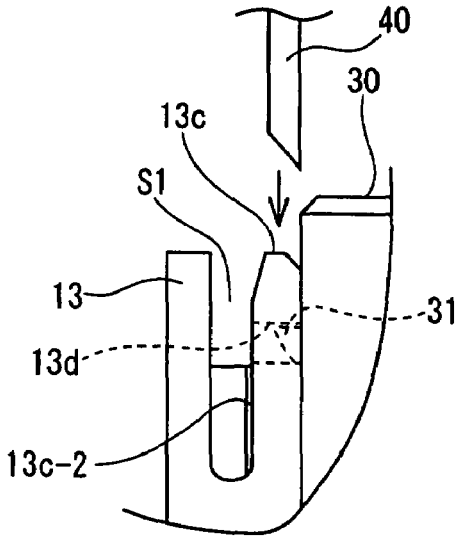
FIG. 6 shows a method of unlocking the connector from the connector accommodation part.

As shown in FIG. 6, in removing the connector 30 fitted in the connector accommodation part 13, an unlocking jig 40 is inserted between the flexing piece 13*c* and the connector 30 to flex the flexible piece 13*c* toward the gap S1 and unlock the connector 30 from the connector accommodation part 13.

In the above-described construction, the peripheral wall 13*a* of the connector accommodation part 13 is cut to form the flexing piece 13*c*, and the locking claw 31 of the connector 30 is locked to the locking hole 13*d* formed through the flexible piece 13*c* to lock the connector 30 to the connector accommodation part 13. Therefore it is unnecessary to provide a large locking construction inside the connector accommodation part 13 and thereby it is possible to make the connector accommodation part 13 small.

Because the flexible piece 13*c* is formed by cutting the peripheral wall 13*a* of the connector accommodation part 13, the flexible piece 13*c* is not easily flexed. Further the connector 30 is locked to the connector accommodation part 13 at the two positions located on the diagonal line of the peripheral wall 13*a* of the connector accommodation part 13. Therefore unlike the conventional construction, it is unnecessary to form the protection wall for protecting the locking position at both sides thereof to prevent the connector from being unlocked and hence a space for forming the protection wall. Thereby it is possible to make the connector accommodation part small.

Because it is unnecessary to form a large locking construction and the protection wall inside the connector accommodation part 13, it is possible to make the connector accommodation part 13 small and thus make the electric junction box 10 compact.

The connector 30 fitted in the connector accommodation part 13 of the electric junction box 10 cannot be unlocked manually therefrom. But it is possible to unlock and remove the connector 30 from the connector accommodation part 13 by inserting the unlocking jig 40 between the flexible piece 13*c* and the connector 30 and by flexing the flexible piece 13*c* toward the back surface side.

Because the peripheral wall 13*a* of the connector accommodation part 13 is shared by the adjacent connector accommodation part 13, the connector accommodation parts 13 can be arranged at a high density. By improving the locking construction of the connector accommodation part 13, as described above, it is possible to make connector accommodation parts 13 small. Further by arranging the connector accommodation parts 13 at a high density, it is possible to make the electric junction box 10 very compact.

The connector accommodation parts 13 can be disposed at a high density by constructing the internal circuit to be accommodated inside the case of the printed conductors 21 of the printed-circuit board 20 and the terminal pins 22 fixedly connected with the printed conductors 21 respectively.

FIG. 7 shows modifications of the embodiment of the present invention.

In the modifications, the positions and number of the flexible pieces 13*c* provided in the connector accommodation part 13 are different from those of the embodiment.

In the modifications shown in FIGS. 7(A) through 7(D), two flexible pieces 13*c* are provided in one connector accommodation part 13. In the modifications shown in FIGS. 7(E) through 7(H), one flexible piece 13*c* is provided in one connector accommodation part 13.

Figure 7A:
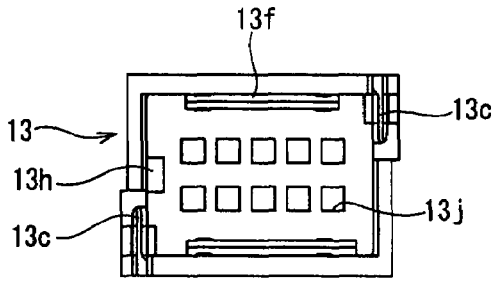
FIGS. 7(A) through 7(H) show connector accommodation parts of modifications of the embodiment of the present invention.

In more detail, in the connector accommodation part 13 shown in FIG. 7(A), the flexible pieces 13*c* are provided at corners disposed on the shorter-side peripheral walls with the flexible pieces 13*c* disposed on one diagonal line of the peripheral wall thereof.

Figure 7E:
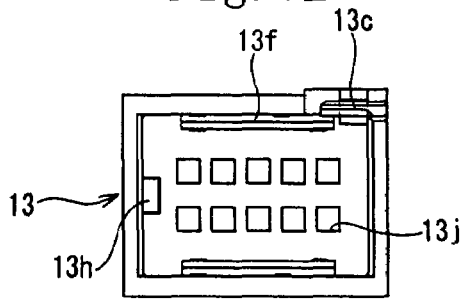
Figure 7B:
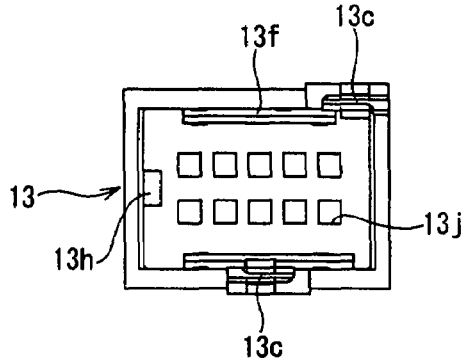

In the connector accommodation part 13 shown in FIG. 7(B), one flexible piece 13*c* is provided at the corner disposed on one longer-side peripheral wall thereof, whereas other flexible piece 13*c* is provided at a central portion of the other longer-side peripheral wall thereof.

Figure 7F:
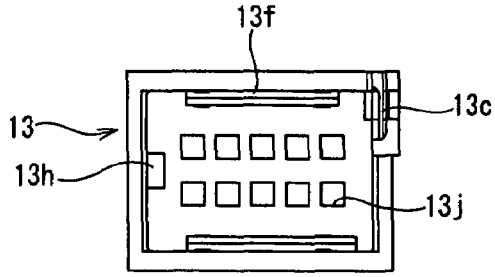
Figure 7C:
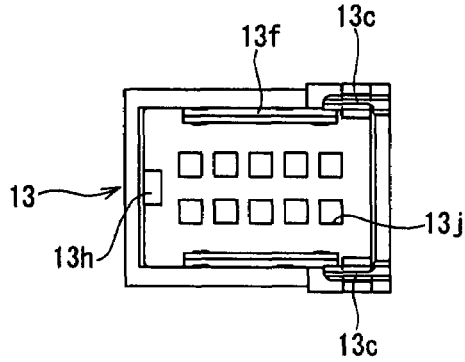

In the connector accommodation part 13 shown in FIG. 7(C), the flexible pieces 13*c* are provided at opposed corners disposed on the longer-side peripheral walls thereof.

Figure 7G:
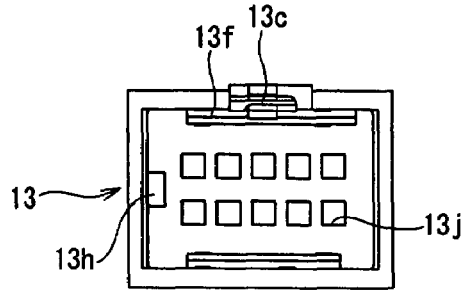
Figure 7D:
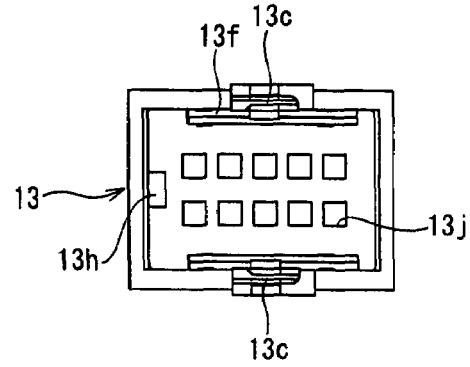

In the connector accommodation part 13 shown in FIG. 7(D), the flexible pieces 13*c* are provided at the central portion of each of the longer-side peripheral walls thereof.

In the connector accommodation part 13 shown in FIG. 7(E), one flexible piece 13*c* is provided at one corner of one longer-side peripheral wall thereof.

In the connector accommodation part 13 shown in FIG. 7(F), one flexible piece 13*c* is provided at one corner of one shorter-side peripheral wall thereof.

In the connector accommodation part 13 shown in FIG. 7(G), one flexible piece 13*c* is provided at the central portion of one longer-side peripheral wall thereof.

Figure 7H:
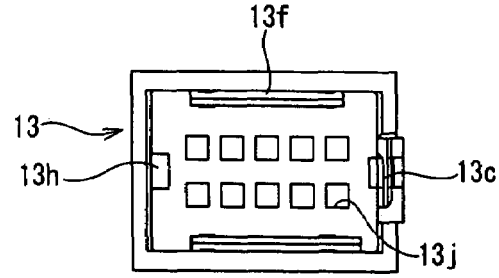
Figure 8:
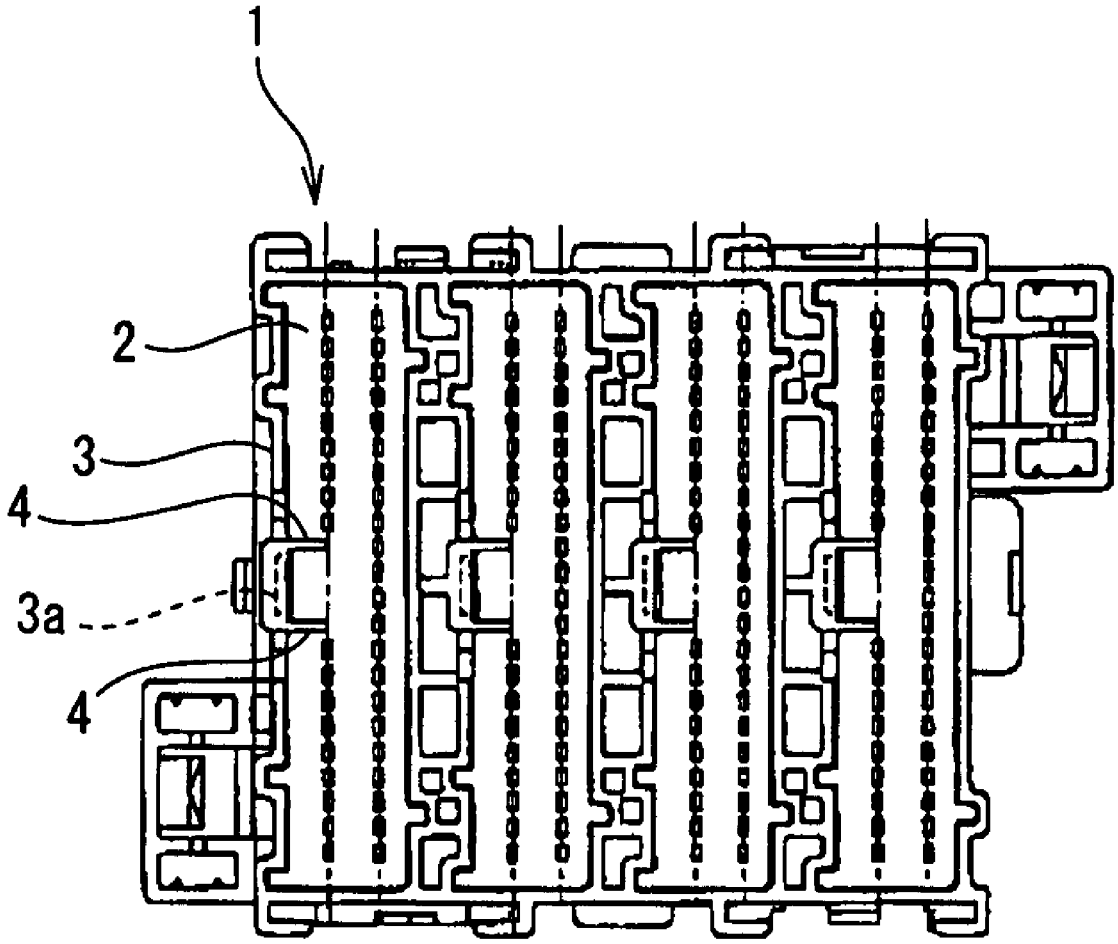
FIG. 8 shows a conventional example.

In the connector accommodation part 13 shown in FIG. 7(H), one flexible piece 13*c* is provided at a central portion of one shorter-side peripheral wall thereof.

As described above, a desired number of the flexible pieces 13*c* can be provided at desired positions of the connector accommodation part 13. Therefore it is possible to enhance the degree of freedom in designing the connector accommodation part 13.

The invention claimed is:

1. In an electric junction box in which connector accommodation parts are provided in a case that accommodates an internal circuit, and connectors connected with a wire harness terminal are fitted in said connector accommodation parts respectively, a peripheral wall of each of said connector accommodation parts is quadrilateral frame-shaped; a flexible piece is formed by cutting the peripheral wall from an inner surface of the peripheral wall on which the connector is fitted toward an inside of the peripheral wall in a shape of L in a horizontal section, so that one side edge of the flexing piece is continuous with the peripheral wall and a gap is formed at a back side and other side edge thereof by the cutting; a locking hole is formed through said flexible piece; a locking claw is formed on each of said connectors to be fitted in said connector accommodation parts respectively at a position thereof opposed to said locking hole of said flexing piece, said locking claw of each of said connectors to be fitted in said connector accommodation parts respectively is inserted into and locked to said locking hole of each flexible piece, so that said connectors are connected to said connector accommodation parts respectively.

2. The electric junction box according to claim 1, wherein said flexible piece is formed at a pair of corners disposed on a diagonal line of said peripheral wall.

3. The electric junction box according to claim 1, wherein in unlocking said connector from said connector accommodation part, said flexible piece is flexed to allow an unlocking jig to be inserted between said flexible piece and said connector.

4. The electric junction box according to claim 1, wherein a stepped convex portion is formed at a lower portion of said peripheral wall inner surface of a side on which said flexible piece is formed with said stepped convex portion spaced at an interval from both corners of said peripheral wall of said connector accommodation part; and a shallow concave portion in which said stepped convex portion is fitted is formed at a position of a surface of said connector opposed to said stepped convex portion.

5. The electric junction box according to claim 1, wherein a stepped projection is formed on an inner surface of a side of said connector accommodation part on which said flexing piece is not formed; and a groove in which said stepped projection is fitted is formed at a position of a surface of said connector opposed to said stepped projection.

6. The electric junction box according to claim 1, wherein a large number of said quadrilateral frame-shaped connector accommodation parts is provided in said case at short pitches with said peripheral wall which have an equal width over a whole length thereof and is extended partitioning said adjacent connector accommodation parts from each other; and said peripheral wall is shared by said adjacent connector accommodation part.

7. The electric junction box according to claim 1, wherein an internal circuit to be accommodated inside said case is constructed of printed conductors of a printed-circuit board and terminal pins fixedly connected with said printed conductors respectively; and said terminal pins are projected into each of said connector accommodation parts from terminal holes formed through a bottom wall of each of said connector accommodation parts so that said terminal pins are fittingly connected with terminals connected with electric wires disposed inside said connector.

8. The electric junction box according to claim 7, wherein electric wires of said wire harness connected with said terminal pins through said connector are electric wires of a signal circuit.

* * * * *